US007496284B2

(12) United States Patent
Pleschinger et al.

(10) Patent No.: US 7,496,284 B2
(45) Date of Patent: Feb. 24, 2009

(54) TUBULAR HEATER WITH INSULATING MATERIAL IN THE CONNECTION END REGION

(75) Inventors: Andreas Pleschinger, Anthering (AT); René Hendler, Judendorf/Strassengel (AT)

(73) Assignee: Bleckmann GmbH & Co. KG, Lamprechtshausen (AT)

( * ) Notice: Subject to any disclaimer, the term of this patent is extended or adjusted under 35 U.S.C. 154(b) by 0 days.

(21) Appl. No.: 11/671,950

(22) Filed: Feb. 6, 2007

(65) Prior Publication Data

US 2007/0194007 A1 Aug. 23, 2007

(30) Foreign Application Priority Data

Feb. 6, 2006 (DE) ..... 10 2006 005 322

(51) Int. Cl.
*F24H 1/10* (2006.01)

(52) U.S. Cl. ..... 392/480; 392/497

(58) Field of Classification Search ..... None
See application file for complete search history.

(56) References Cited

U.S. PATENT DOCUMENTS 3,657,519 A * 4/1972 Pease ..... 219/536
3,732,398 A * 5/1973 Pease ..... 219/536
3,839,623 A * 10/1974 Portmann ..... 219/541
3,934,333 A * 1/1976 Churchill ..... 29/611
3,970,817 A * 7/1976 Boyd ..... 219/209
4,186,369 A * 1/1980 Attridge et al. ..... 338/274
4,263,577 A * 4/1981 Bauchert et al. ..... 338/242
4,273,993 A * 6/1981 Seeley ..... 219/541
4,287,502 A * 9/1981 Nickmeyer ..... 338/274
4,346,287 A * 8/1982 Desloge ..... 219/541
5,486,682 A * 1/1996 Rysemus ..... 219/544
2006/0289474 A1* 12/2006 Johnson ..... 219/544

* cited by examiner

*Primary Examiner*—Thor S Campbell
(74) *Attorney, Agent, or Firm*—Seed IP Law Group PLLC

(57) ABSTRACT

A heating apparatus for heating a fluid, in particular in domestic appliances, which comprises a tubular casing, at least one electrical resistance heating wire which is arranged in the interior of the tubular casing and which is embedded in an electrically insulating, heat-conducting insulating material in the tubular casing, at least one connection unit which is arranged in the interior of the tubular casing and which is passed outwardly out of the tubular casing for connection of the electrical resistance heating wire to an electrical energy source disposed outside the tubular casing, and at least one closure bead which closes the opening of the tubular casing. It is further provided that the connection unit is also surrounded by the insulating material within the tubular casing to the closure bead and the closure bead is, at its outside, provided with at least one filling slot which extends over its entire axial length.

11 Claims, 5 Drawing Sheets

TUBULAR HEATER WITH INSULATING MATERIAL IN THE CONNECTION END REGION

CROSS-REFERENCE TO RELATED APPLICATION

This application claims priority to German application No. 10 2006 005 322.2, filed Feb. 6, 2006, which application is incorporated herein by reference in its entirety.

BACKGROUND OF THE INVENTION

1. Field of the Invention

The present invention concerns a heating apparatus for heating a fluid, in particular in domestic appliances, which comprises a tubular casing, at least one electrical resistance heating wire which is arranged in the interior of the tubular casing and which is embedded in an electrically insulating, heat-conducting insulating material in the tubular casing, at least one connection unit which is arranged in the interior of the tubular casing and which is passed outwardly out of the tubular casing for connection of the electrical resistance heating wire to an electrical energy source disposed outside the tubular casing, and at least one closure bead which closes the opening of the tubular casing.

2. Description of the Related Art

European patent application No 0 086 465 discloses a heating apparatus in the form of a tubular heater which is of the structure referred to hereinbefore. In that previously known heating apparatus, the connection unit is connected at its one end by way of a connecting pin to the electrical resistance heating wire. The other end of the connection unit projects out of the tubular casing of the previously known tubular heater and serves to connect the tubular heater to an electrical energy source. FIG. 1 shows a previously known heating apparatus of that kind.

As can be seen from FIG. 1 the region of the connection unit A, in particular the region of the overload safeguard means Ü is separated from the region of the electrical resistance heating wire W by a first disk $SI_1$ of insulating resin. An insulating material IM is introduced into the region of the electrical resistance heating wire W. In comparison the major part of the connection unit A is enclosed by a plastic sleeve K which electrically insulates the connection unit A with respect to the tubular casing M. To connect the connecting pin AB to the overload safeguard means Ü a copper sleeve KH is pushed on to the end of the connecting pin A, that faces away from the interior of the tubular casing M. At its other end the copper sleeve KH is also pushed on to the thermal overload safeguard means Ü. Disposed in adjoining relationship therewith in the direction of the front end of the tubular casing M are two further material disks $SI_2$, $SI_3$ of insulating resin and an insulating bead IP.

That previously known heating apparatus suffers from a series of disadvantages: Thus, firstly a large number of individual parts are required in order to be able to arrange the connection unit in functionally secure and reliable relationship in the interior of the tubular casing. Due to that large number of parts but also due to the large number resulting therefrom of necessary handling operations for assembling that extensive number of components, the costs of the previously known heating apparatus are considerably increased. Furthermore the arrangement suffers from large tolerance additions. In addition after the insulating material has been introduced, for the purposes of compacting it, the tubular casing has to be reduced in size by way of reducing rollers from one diameter, for example 10 mm, to a reduced diameter, for example 8.5 mm. That can be effected both prior to assembly of the connection unit and also thereafter, in which respect in the latter case the reducing rollers must be lifted off the tubular casing in good time in order to avoid damaging the connection unit, in particular the thermal overload safeguard means. The reducing operation makes it necessary for the tubular casing of the heating apparatus to be subjected to a re-crystallization annealing operation as otherwise there is the danger that, in a process for bending the tubular casing in order to impart thereto for example a U-shaped or W-shaped configuration, the tubular casing would tear. Furthermore the heating apparatuses have to be insulated as otherwise the filling material will absorb moisture and thus a short-circuit can occur from the electrical resistance heating wire to the tubular casing.

BRIEF SUMMARY OF THE INVENTION

One object of the present invention is to reduce the cost involved in the production of a heating apparatus of the kind set forth in the opening part of this specification.

In one embodiment a heating apparatus for heating a fluid, in particular in domestic appliances, comprise a tubular casing, at least one electrical resistance heating wire which is arranged in the interior of the tubular casing and which is embedded in an electrically insulating, heat-conducting insulating material in the tubular casing, at least one connection unit which is arranged in the interior of the tubular casing and which is passed outwardly out of the tubular casing for connection of the electrical resistance heating wire to an electrical energy source disposed outside the tubular casing, and at least one closure bead which closes the opening of the tubular casing, wherein the connection unit is also surrounded by the insulating material within the tubular casing to the closure bead, and wherein at its outside the closure bead is provided with at least one filling slot which extends over its entire axial length.

By replacing the plastic sleeve as is used in the state of the art for electrical insulation of the connection unit with respect to the tubular casing, by the insulating material, it is now possible for the number of parts necessary to assemble the connection unit to be reduced. For, besides the plastic sleeve which is no longer present, the separating or insulating disks of synthetic resin which in the known heating apparatus are arranged on both sides of the region in which the thermal overload safeguard means is disposed are also no longer required. Furthermore, there is also no longer any need for the copper sleeve which afforded thermal conduction from the connecting pin to the thermal overload safeguard means in the previously known heating apparatus. Rather, the thermal overload safeguard means can be connected directly to the connecting pin, for example by the wire of the overload safeguard means being connected directly to the connecting pin, for example by crimping. As the number of parts has been markedly reduced in comparison with the previously known heating apparatuses, the number of handling procedures or assembly steps when assembling the heating apparatus according to the invention together is considerably reduced. Overall therefore the solution according to the invention makes a considerable cost saving.

In the heating apparatus, as described in the introduction above, during the operation of assembling the heating apparatus the electrical resistance heating wire together with the connecting pin or pins is inserted into the tubular casing. The tubular casing is then filled with the insulating material. Thereupon the first insulating disk of synthetic resin is introduced into the tubular casing, whereupon the copper sleeve together with the thermal overload safeguard means is pushed on to the connecting pin. Then the two further insulating disks of synthetic resin as well as the insulating bead are fitted into the end of the tubular casing and the end of the tubular casing is plastically deformed and thus closed. If however the closure bead is provided at its outside with at least one filling slot which extends over its entire axial length, there is the possibility that the entire unit consisting of the electrical resistance heating wire and the connection unit which in turn comprises the connecting pin that is connected on the one hand to the electrical resistance heating wire and on the other hand to the thermal overload safeguard means, the thermal overload safeguard means itself and the closure bead, can be introduced into the tubular casing before the insulating material is filled thereinto. The insulating material can then be introduced into the tubular casing when previously equipped in that way, by way of the at least one filling slot.

In one embodiment, the closure bead has at its outside overall four filling slots which are, in a certain embodiment, preferably distributed in the peripheral direction in uniform pitch relationship, the filling operation can be carried out more quickly. In that respect, irrespective of the number of filling slots, there is the possibility of using at the one end of the heating apparatus or the tubular casing, a closure bead which does not have a filling slot and which therefore closes off that end of the tubular casing both sealingly in relation to an escape of the insulating material from the tubular casing and also sealingly in relation to access of any other medium or fluid into the interior of the tubular casing. A closure bead with at least one filling slot is then provided at the other end of the tubular casing.

After the insulating material has been introduced into the interior of the tubular casing by way of the filling slots, the at least one filling slot has to be closed. That can be effected on the one hand by at least one deformable closure nose being provided on the closure bead at its side that faces away from the interior of the tubular casing. That deformable closure nose can be so deformed after the filling operation that it closes the filling slot in medium-tight relationship. That can be effected for example by the at least one closure nose of the closure bead comprising a thermally deformable plastic material so that the closing operation can be implemented with a hot stamping tool. If the closure bead has a plurality of filling slots, a closure nose of that kind is provided for each of those filling slots.

A further alternative for closing the filling slot or slots of the closure bead provides that a sealing bead adjoins the closure bead in the direction of the outside of the tubular casing, that is to say in the direction of the opening of the tubular casing, with the sealing bead closing off the tubular casing in medium-tight relationship.

In the heating apparatus, as described in the introduction above, a rolling operation is effected to compact the insulating material after introduction of the insulating material and prior to fitment of the overload safeguard means. In that rolling operation, the diameter of the tubular casing is reduced for example from 10 mm to 8.5 mm. The last-mentioned diameter is a diameter which is frequently found in practice in respect of heating apparatuses of that kind as that outside diameter corresponds to the inside diameters of through openings in a configuration for holding the heating apparatus to a fluid container to be heated. In contrast thereto it is provided in accordance with the invention that the tubular casing is already of a diameter which can be used for corresponding flange assemblies and the like, that is to say, it is no longer necessary for the diameter of the tubular casing to be reduced. Rather, in accordance with the invention, the tubular casing is only subjected to a pressing operation. By virtue thereof, there is then also no longer any need to effect subsequent re-crystallization annealing.

The elimination of the need to have to perform a re-crystallizations annealing operation means that there is also the possibility of using siliconised magnesium oxide instead of the insulating material which hitherto is frequently used in practice, namely magnesium oxide, whereby insulation by synthetic resin is no longer necessary. In this connection it should also be noted that it is naturally basically further possible to use a standard material such as magnesium oxide as the insulating material and for the heating apparatus to be sealed off in relation to the exterior with a thermoelastic filling bead which closes off the tubular casing in medium-tight relationship. In that respect the heating apparatus can additionally be sealed off in relation to the exterior with a cover resin.

BRIEF DESCRIPTION OF THE SEVERAL VIEWS OF THE DRAWINGS

Further advantageous configurations and an embodiment by way of example of the heating apparatus according to the invention are described hereinafter with reference to the drawings. The terms used in the description of the specific embodiment 'left', 'right', 'up' and 'down' relate to the Figures in an orientation in which the Figure identifications and references can be normally read. In the drawing.

DETAILED DESCRIPTION OF THE INVENTION

Figure 1:
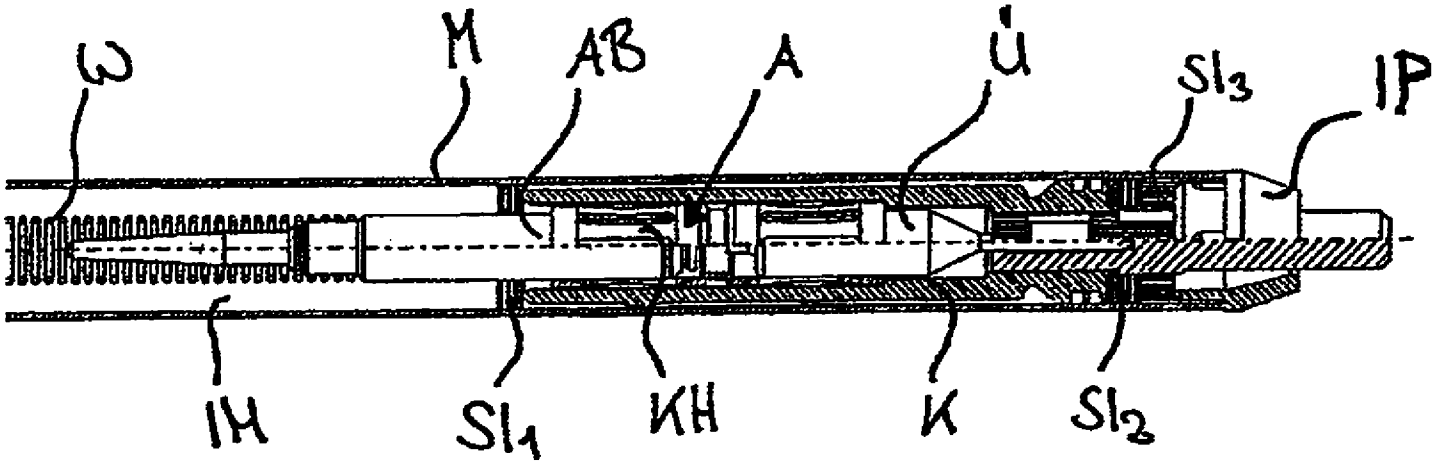
FIG. 1 (Prior Art)
FIG. 1 is a partial longitudinal section through a heating apparatus in accordance with the state of the art.
Figure 2A:
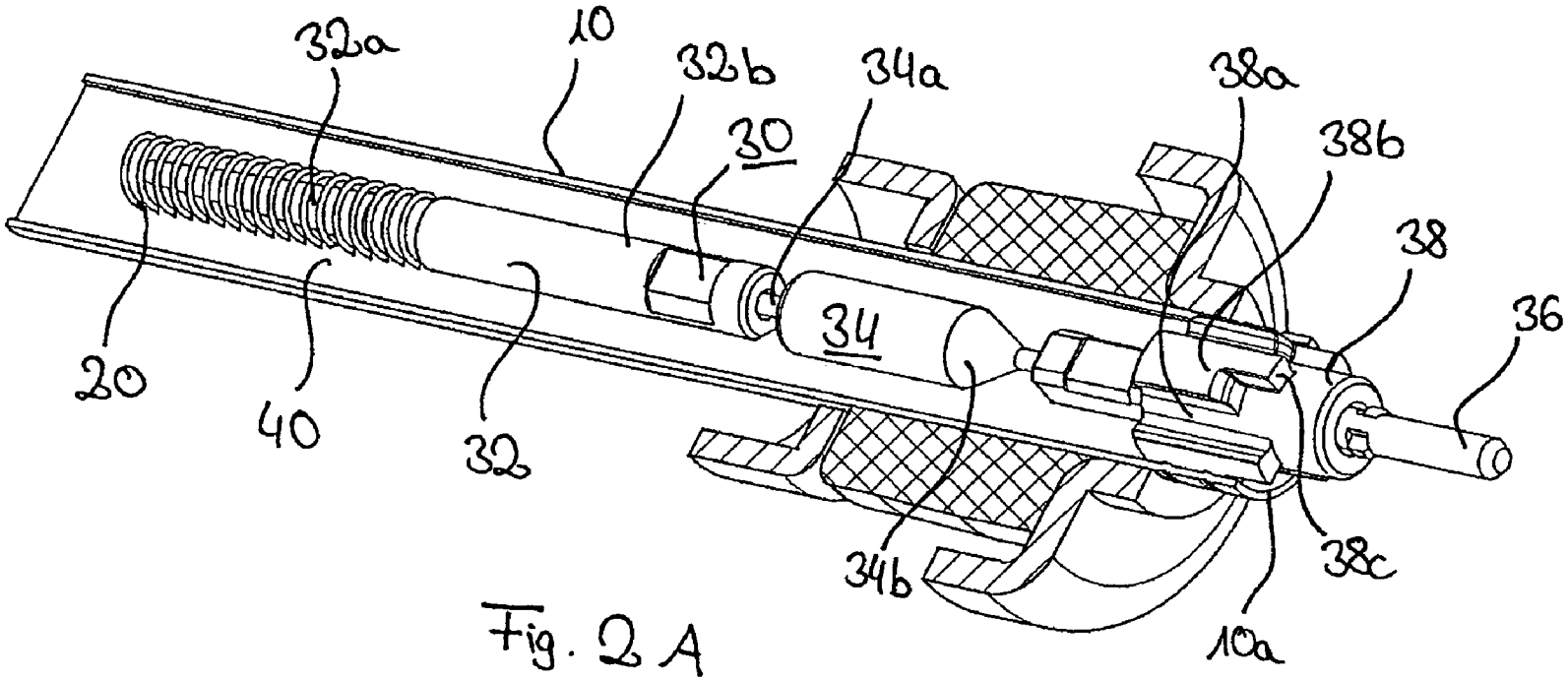
FIGS. 2A and 2B show a perspective and a two-dimensional partial section of a heating apparatus according to one embodiment.
Figure 2B:
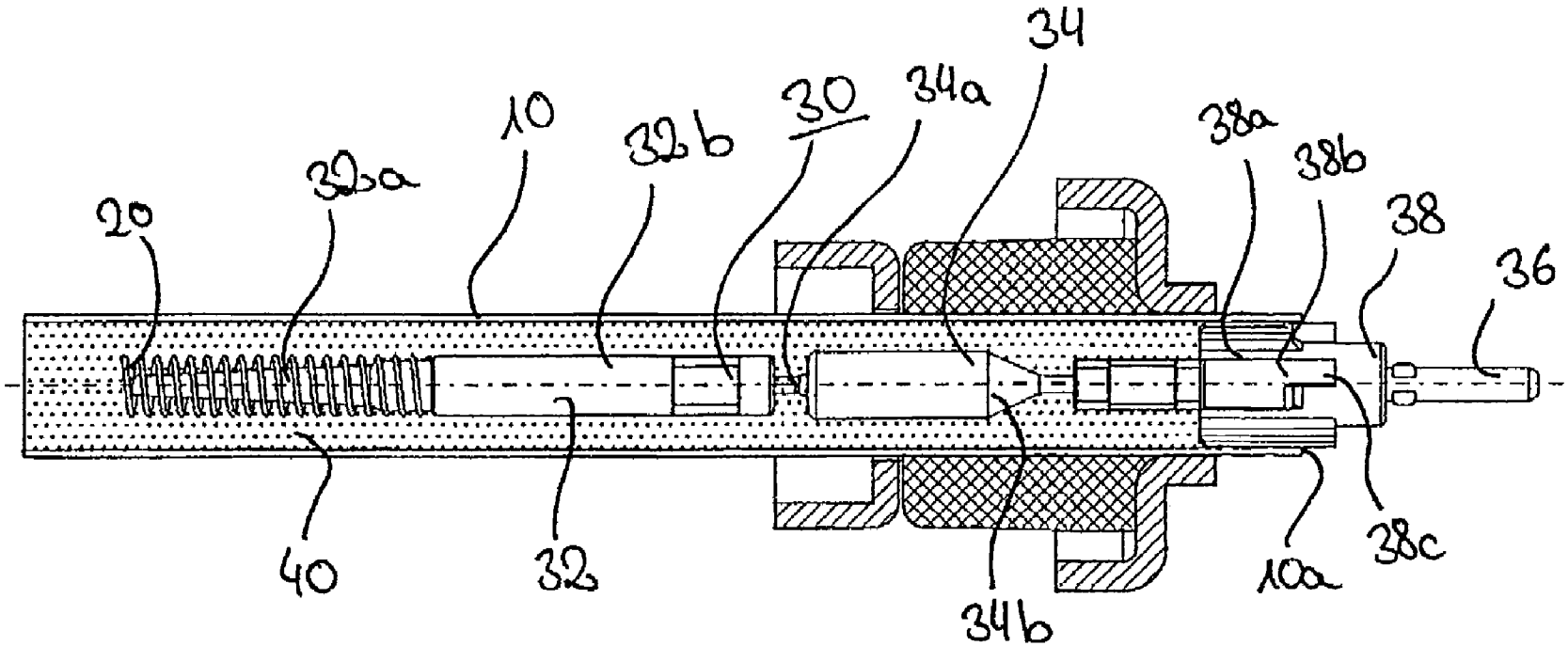

One embodiment of the heating apparatus which is shown in partial longitudinal section in FIGS. 2A and 2B has as components or units thereof a tubular casing 10, an electrical resistance heating wire 20, a connection unit 30 and an insulating material 40. Those individual components are described hereinafter.

The tubular casing 10 comprises a material which is an adequate heat conductor or a good heat conductor such as for example high-quality steel or aluminum and is of an at least approximately circular cross-section. The two ends 10*a* of the tubular casing 10 are open outwardly, in which respect it is to be observed that only one of the two ends 10*a* is shown in FIGS. 2A and 2B.

Although not shown, the tubular casing 10 can be put into any external shape, for example it can be in the form of a tube extending in a straight line or it can be bent in the form of the letter 'U' or 'W'. In contrast to the tubular casings of known heating apparatuses, from the outset, that is to say at the beginning of assembly of the components or units disposed in the tubular casing 10, the tubular casing 10 is already of the outside diameter which it involves in the installed condition, for example in a fluid container in a dishwashing machine or a laundry washing machine.

As can be seen from FIGS. 2A and 2B the electrical resistance heating wire 20 which is arranged in the interior of the tubular casing 10 in at least approximately coaxial relationship with the longitudinal center line thereof and which is made from an electrical resistance material which heats up when a current flows therethrough is wound to provide a heating coil. At its two free ends the electrical resistance heating wire 20 is connected to the respective connection unit 30 which is disposed there. That connection can be made for example by welding.

The connection unit 30 firstly has a connecting pin 32 which is also arranged at least approximately coaxially with respect to the longitudinal center line of the tubular casing 10 and which can be made from a material which is a good conductor of heat and electricity, such as for example copper. In order to make it easier to fit the electrical resistance heating wire 20 to the connecting pin 32, the latter has a conical portion 32*a* at its end which faces towards the electrical resistance heating wire 20 so that the electrical resistance heating wire 20 which has been wound to form the heating coil can be easily pushed on to the connecting pin 32 and, as already mentioned, can be fixed there by a spot weld, for example.

Disposed adjoining the conical portion 32*a* is a circular-cylindrical portion 32*b* of the connecting pin 32. The latter is connected to a thermal overload safeguard means 34 which is also arranged in at least approximately coaxial relationship with the longitudinal center line of the tubular casing 10, in such a way that a connecting wire 34*a* of the thermal overload safeguard means 34 is connected to the right-hand end of the connecting pin 32 by a crimping or notching operation. The thermal overload safeguard means 34 can be formed for example by a blow-out fuse which interrupts the electrical connection between the electrical resistance heating wire 20 and a power source (not shown) when a predetermined temperature is exceeded.

At the right-hand end 34*b* of the thermal overload safeguard means 34 which is of a conical configuration whereas otherwise the thermal overload safeguard means 34 is of a substantially circular-cylindrical cross-section, a connecting wire portion 36 is connected to the thermal overload safeguard means 34, for example by a crimping or notching operation. That connecting wire portion 36 is extended outwardly out of the tubular casing 10 and serves to connect the electrical heating apparatus to the above-mentioned electrical energy source (not further shown).

Figure 3:
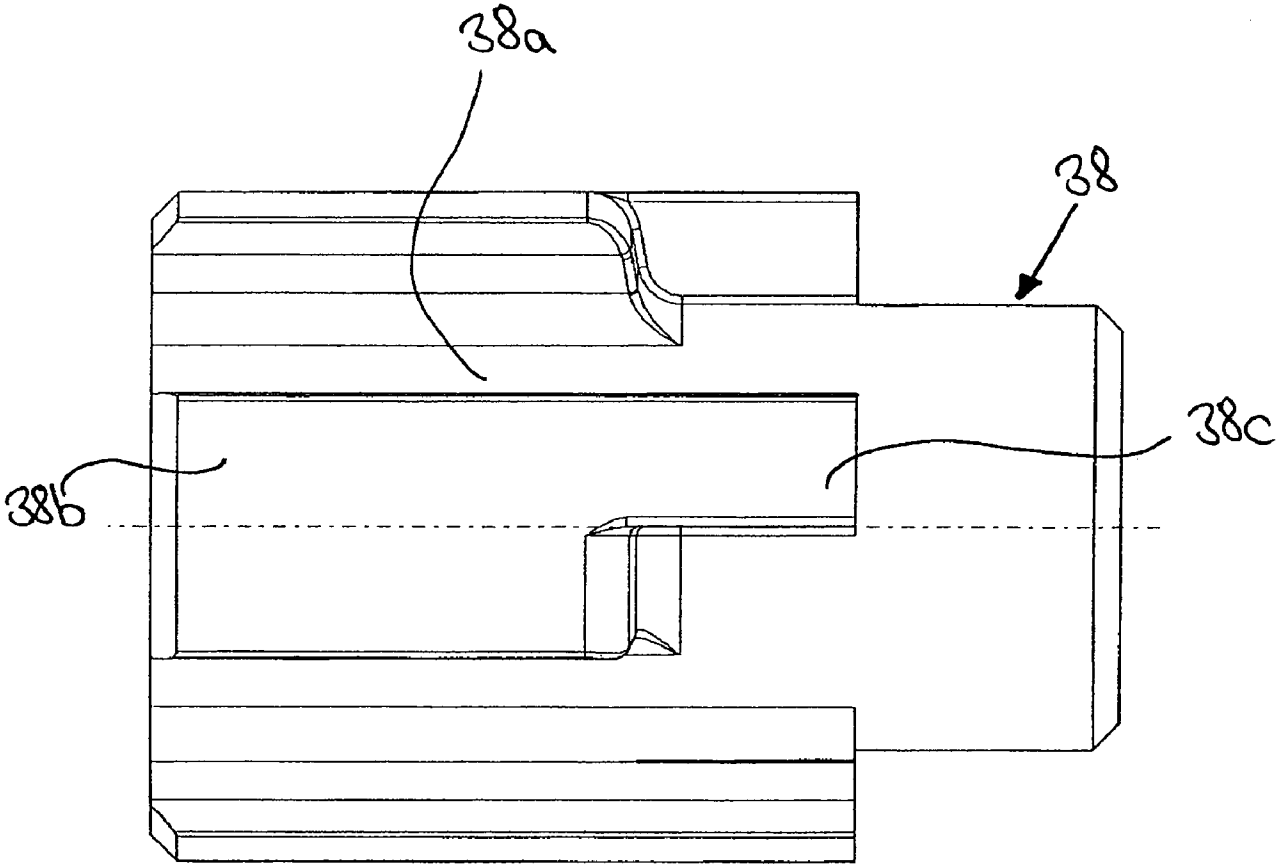
FIG. 3 shows a plan view of a closure bead according to one embodiment.
Figure 4:
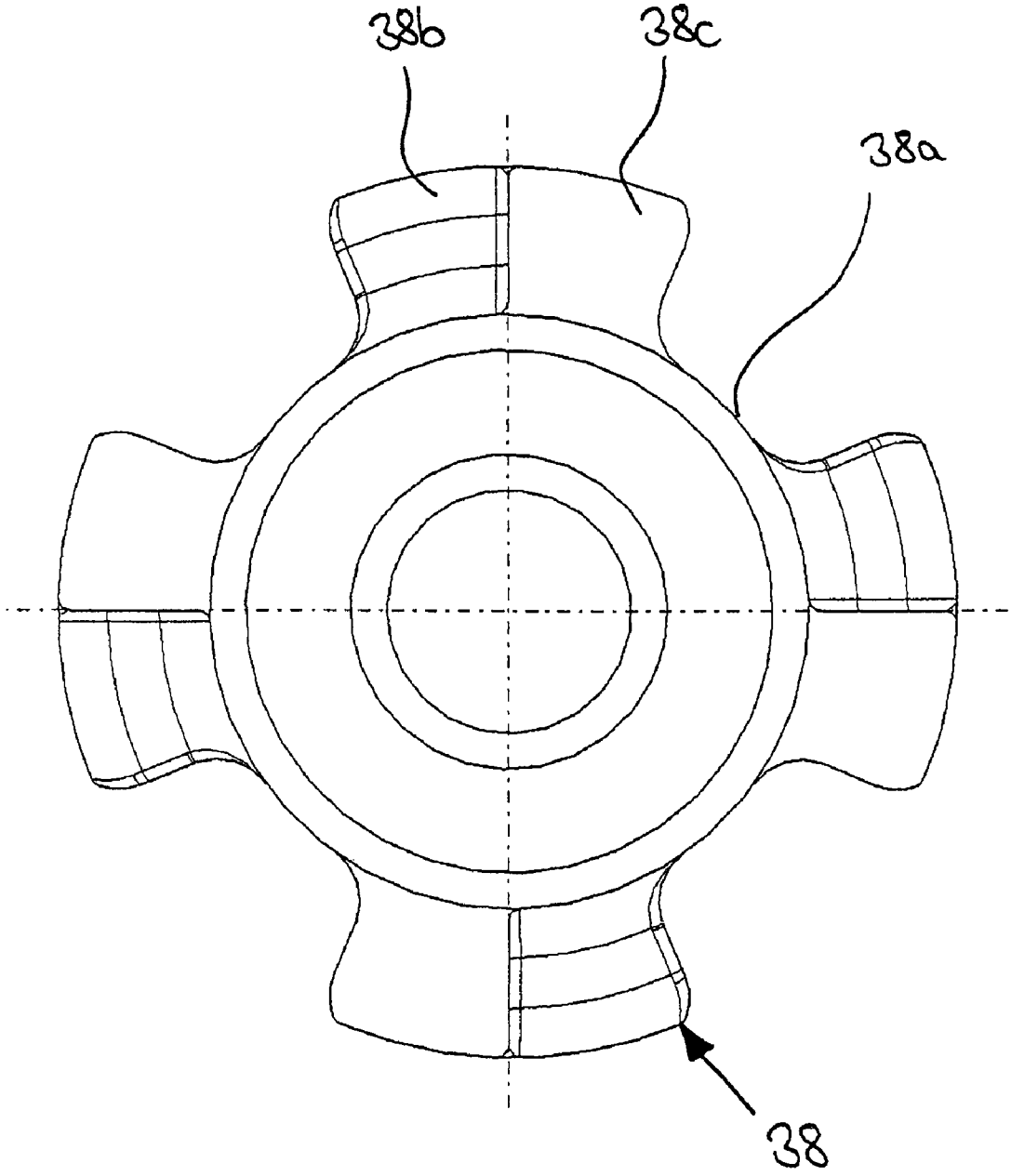
FIG. 4 shows an end view of the closure bead shown in FIG. 3.

Also provided at the right-hand end 10*a* of the tubular casing 10 is a closure bead 38 which is shown in greater detail in FIGS. 3 and 4. The closure bead 38 is made from a thermally deformable plastic material. As can be seen from FIGS. 2A, 2B and 4 the closure bead 38 has four filling slots 38*a* which are distributed in a uniform pitch relationship in the peripheral direction of the closure bead 38. Those filling slots 38*a* extend over the entire axial length of the closure bead 38. Provided between the individual filling slots 38*a* are bar portions 38*b* whose outside diameter at least approximately corresponds to the inside diameter of the tubular casing 10. At the end thereof which faces outwardly, provided on the bar portions 38*a* are noses 38*c* which after a filling operation with an insulating material 40, as is described in greater detail hereinafter, close the filling slots 38*a* by virtue of a thermal deformation operation. As can be seen from FIG. 2 the closure bead 38 projects beyond the right-hand end 10*a* of the tubular casing 10. It is fixed in its axial position by two notchings or crimps on the connecting wire portion 36.

It is also to be noted that the region of the second connecting end of the heating apparatus according to the invention, at the side which is not shown here, can equally be of the same structure as described hereinbefore. Equally however there is also the possibility that, instead of the above-described closure bead 38, a different closure bead can be used, for example a closure bead which has no filling slots and the outside diameter of which substantially corresponds to the inside diameter of the inside diameter of the tubular casing 10. That closure bead can then be fixed for example by an adhesive operation in the end there of the tubular casing 10.

After the electrical resistance heating wire 20 with the two connection units 30 mounted at the two ends thereof has been introduced into the interior of the tubular casing 10 and is fixed in respect of the axial arrangement thereof in its appropriate position, the siliconised insulating material 40 can be introduced by way of the filling slots 38*a* of the at least one closure bead 38 or both closure beads 38. That siliconised insulating material 40 serves for electrical insulation of the electrical resistance heating wire 20 and the further electrical current-carrying components of the connection unit 30, that is to say the connecting pin 32, the thermal overload safeguard means 34 and the connecting wire portion 36, with respect to the inside wall of the tubular casing 10. In addition the siliconised insulating material has to conduct the heat generated by the electrical resistance heating wire 20 to the tubular casing 10. After the siliconised insulating material 40 has been introduced completely from the end of the one closure bead 38, that faces towards the inside of the tubular casing 10, to the end of the other closure bead 38, that also faces towards the inside of the tubular casing 10, the closure noses 38*b* of the closure bead 38 are deformed by a thermal deformation operation in such a way that the filling slots 38*a* are closed in medium-tight relationship.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A heating apparatus for heating a fluid, the apparatus comprising:

(a) a tubular casing;

(b) at least one electrical resistance heating wire, which is arranged in the interior of the tubular casing and which is embedded in an electrically insulating, heat-conducting insulating material in the tubular casing;

(c) at least one connection unit which is arranged in the interior of the tubular casing and which is passed outwardly out of the tubular casing for connection of the electrical resistance heating wire to an electrical energy source disposed outside the tubular casing;

(d) at least one closure bead, which closes the opening of the tubular casing, wherein the connection unit is also surrounded by the insulating material within the tubular casing to the closure bead, and wherein at its outside the closure bead is provided with at least one filling slot for filling of siliconized magnesium oxide as the insulating material into the tubular casing, which filling slot extends over its entire axial length of the closure bead.

2. A heating apparatus as set forth in claim 1 wherein at its outside the closure bead has a total of four filling slots which are distributed in uniform pitch relationship in the peripheral direction.

3. A heating apparatus as set forth in claim 1 wherein at its side that faces away from the interior of the tubular casing the closure bead is provided with at least one deformable closure nose.

4. A heating apparatus as set forth in claim 3 wherein at least the closure nose of the closure bead comprises a thermally deformable plastic material.

5. A heating apparatus as set forth in claim 3 wherein the closure nose of the closure bead is deformable after the conclusion of the filling operation in such a way that it fluid-tightly closes the filling slot.

6. A heating apparatus as set forth in claim 1 wherein at least one sealing bead adjoins the closure bead in the direction of the outside of the tubular casing.

7. A heating apparatus as set forth in claim 1 wherein the connection unit includes at least one overload safeguard means which is also surrounded by the insulating material.

8. A heating apparatus as set forth in claim 1 wherein the connection unit includes at least one connecting pin which is embedded in the insulating material and which is connected to the electrical resistance heating wire on the one hand and to an optionally present overload safeguard means on the other hand.

9. A heating apparatus as set forth in claim 1 wherein the tubular casing can be subjected to a pressing operation in the heating region.

10. A heating apparatus as set forth in claim 1 wherein the insulating material is a magnesium oxide and the heating apparatus is sealed off relative to the exterior with a thermoelastic filling bead which closes off the tubular casing in medium-tight relationship.

11. A heating apparatus as set forth in claim 10 wherein the heating apparatus is additionally sealed off relative to the exterior with a cover resin.

* * * * *